US011192115B2

(12) United States Patent
Lindner et al.

(10) Patent No.: US 11,192,115 B2
(45) Date of Patent: Dec. 7, 2021

(54) DUAL-SHAFT SHREDDER HAVING A QUICK-CHANGE DEVICE

(71) Applicants: Manuel Lindner, Spittal/Drau (AT); Peter Schiffer, Millstatt (AT); Mario Fritz, Millstatt (AT)

(72) Inventors: Manuel Lindner, Spittal/Drau (AT); Peter Schiffer, Millstatt (AT); Mario Fritz, Millstatt (AT)

(73) Assignee: MANUEL LINDNER, Spittal/Drau (AT)

( * ) Notice: Subject to any disclaimer, the term of this patent is extended or adjusted under 35 U.S.C. 154(b) by 304 days.

(21) Appl. No.: 16/304,202

(22) PCT Filed: May 23, 2017

(86) PCT No.: PCT/EP2017/062410
§ 371 (c)(1),
(2) Date: Nov. 23, 2018

(87) PCT Pub. No.: WO2017/202842
PCT Pub. Date: Nov. 30, 2017

(65) Prior Publication Data

US 2020/0316609 A1 Oct. 8, 2020

(30) Foreign Application Priority Data

May 23, 2016 (EP) ..... 16170895

(51) Int. Cl.
*B02C 4/42* (2006.01)
*B02C 4/08* (2006.01)
(Continued)

(52) U.S. Cl.
CPC ..... *B02C 4/08* (2013.01); *B02C 4/32* (2013.01); *B02C 4/42* (2013.01); *B02C 18/142* (2013.01);
(Continued)

(58) Field of Classification Search
CPC ..... B02C 18/06; B02C 18/007; B02C 18/142; B02C 18/146; B02C 2018/162; B02C 18/2233; B02C 18/2225
(Continued)

(56) References Cited

U.S. PATENT DOCUMENTS 4,385,732 A * 5/1983 Williams ..... B02C 18/0084 241/236
4,630,781 A * 12/1986 Brown, Jr. ..... B02C 4/08 241/159
(Continued)

FOREIGN PATENT DOCUMENTS

CN 86104686 A 1/1988
DE 4315671 A1 11/1994
(Continued)

OTHER PUBLICATIONS

DE 202012004469 U1, Machine Translation, 2013 (Year: 2013).*
(Continued)

*Primary Examiner* — Faye Francis
(74) *Attorney, Agent, or Firm* — Moore & Van Allen PLLC; Henry B. Ward, III

(57) ABSTRACT

A shredding device is provided comprising two shredding shafts arranged parallel to each other with shredding elements arranged thereon, wherein the shredding shafts are preferably rotatable mechanically synchronized to each other. A shaft-side coupling element is connected to a respective first end of the shredding shafts. The shredding device includes a housing with a housing-side coupling element is provided that can be coupled to the shaft-side coupling element. The shredding device includes a displacement device enabling displacement of the shredding shafts for decoupling and coupling the shaft-side coupling element from or to the housing-side coupling element.

18 Claims, 11 Drawing Sheets

(51) Int. Cl.

| | |
|---|---|
| ***B02C 4/32*** | (2006.01) |
| ***B02C 18/14*** | (2006.01) |
| *B02C 18/16* | (2006.01) |
| *B02C 18/06* | (2006.01) |
| *B02C 18/00* | (2006.01) |

(52) U.S. Cl.
CPC ..... *B02C 18/0007* (2013.01); *B02C 18/06* (2013.01); *B02C 18/146* (2013.01); *B02C 2018/162* (2013.01)

(58) Field of Classification Search
USPC ..... 241/236, 285.2, 285.3, 224
See application file for complete search history.

(56) References Cited

U.S. PATENT DOCUMENTS

| | | | | |
|---|---|---|---|---|
| 4,685,626 | A | 8/1987 | Kerdiles et al. | |
| 4,718,614 | A * | 1/1988 | Hausler | B02C 13/282 241/189.1 |
| 5,580,009 | A * | 12/1996 | Kennedy | B02C 18/142 241/236 |
| 10,940,483 | B2 * | 3/2021 | Hoehn | B02C 4/38 |
| 2007/0187538 | A1 * | 8/2007 | Wollenhaupt | B21D 22/22 72/350 |
| 2010/0176233 | A1 * | 7/2010 | Rota | B02C 18/2291 241/189.2 |
| 2014/0103152 | A1 * | 4/2014 | Van der Galien | B02C 23/16 241/30 |
| 2015/0217299 | A1 * | 8/2015 | Doppstadt | B02C 18/20 241/87.1 |
| 2020/0129988 | A1 * | 4/2020 | Doppstadt | B02C 18/145 |

FOREIGN PATENT DOCUMENTS

| | | | | |
|---|---|---|---|---|
| DE | 202012004469 | U1 * | 8/2013 | B02C 18/142 |
| EP | 1348491 | A1 | 10/2003 | |
| EP | 2662143 | A2 * | 11/2013 | B30B 15/028 |
| EP | 2662143 | A2 | 11/2013 | |
| WO | 2014026916 | A1 | 2/2014 | |

OTHER PUBLICATIONS

AdvancedManipulators. (Nov. 14, 2011). Industrial Manipulator Lifting Sockets [Video]. Youtube, https://www.youtube.com/watch?v=Eg1c7cleoq8&t=7s (Year: 2011).*

International Search Report issued for corresponding International Patent Application No. PCT/EP2017/062410 dated Aug. 10, 2017.

Written Opinion issued for corresponding International Patent Application No. PCT/EP2017/062410 dated Aug. 10, 2017 (English language translation not attached).

Second Office Action issued by the Chinese Patent Office for Chinese Application No. 201780032167.8, dated Feb. 22, 2021.

Search Report issued by the Chinese Patent Office for Chinese Application No. 201780032167.8, dated Feb. 4, 2021.

Third Office Action issued by the Chinese Patent Office for Chinese Patent Application No. 201780032167.8, dated Jul. 15, 2021.

* cited by examiner

--PRIOR ART--

--PRIOR ART--

--PRIOR ART--

--PRIOR ART--

DUAL-SHAFT SHREDDER HAVING A QUICK-CHANGE DEVICE

FIELD OF THE INVENTION

The invention relates to a shredding device comprising: two shredding shafts arranged parallel to each other with shredding elements arranged thereon, wherein the shredding shafts are preferably rotatable mechanically synchronized to each other; a shaft-side coupling element connected to a respective first end of the shredding shafts; and a housing with a housing-side coupling element which can be coupled to the shaft-side coupling element.

So-called dual-shaft shredders are widely used for shredding a wide variety of input materials. These dual-shaft shredders differ from so-called single-shaft shredders in that they have two shredding shafts. The shredding itself takes place with the tools on the two shafts to each other, but also against fixed shredding tools.

The so-called rotary shears are not part of the design of these dual-shaft shredders, even if they have two shredding shafts. Rotary shears only have so-called cutting discs with gaps. The material to be shredded enters the gaps and is factually cut by the disc of the other shaft. The rotary shears have no shredding tools that project beyond the width of the cutting discs.

It is true that the dual-shaft shredders mentioned here also have discs or carrying elements, only these carry additional shredding tools, so-called separating elements, which project considerably, up to the width of the disc on one side, beyond the width or thickness of the discs.

Such dual-shaft shredders of this design are predominantly used in the waste and recycling industry and in the field of biomass. For example, for the shredding of household waste, commercial and production waste of all kinds, mixed construction-site waste, waste wood, green waste and other biomass, but also iron and other metal scrap.

In these dual-shaft shredders, a distinction is made according to a further decisive criterion. This is whether the two shredding shafts are driven in such a way that they can only rotate synchronously or asynchronously about their own axis with the shredding tools.

In the case of dual-shaft shredders with asynchronous drive, both shredding shafts can be operated at different speeds and directions of rotation. With synchronously driven dual-shaft shredders, shredding shafts only rotate in synchronous speed and in respectively opposite rotational direction, so the two shredding shafts move towards or away from each other at the same speed.

This synchronous drive of dual-shaft shredders allows a completely different arrangement of the shredding tools at the shredding shafts than with dual-shaft shredders with asynchronous drive.

When the shredding shafts are driven asynchronously, the shredding tools located on them must be designed in such a way that mutual contact of and thus damage to the shredding tools is ruled out, since the shafts can rotate in different speeds and rotational directions.

On the other hand, in the case of dual-shaft shredders with synchronous drive, the shredding tools can be designed in such a way that the tools of the two shafts mesh with one another, and the tools of the one shaft respectively carry out the shredding with the tools of the other shaft, since the synchronous drive of the shredding shafts, when the shredding tools are correctly designed, can prevent mutual damage.

This technical feature of the dual-shaft shredders with synchronous drive enables a higher degree of shredding of the input materials and, thanks to the sieve-like effect of the shredding tools located on both shredding shafts, a more uniform piece size is achieved than with asynchronously driven dual-shaft shredders.

The dual-shaft shredders further described here are therefore exclusively those with synchronous drive of the two shredding shafts.

BACKGROUND OF THE INVENTION

These dual-shaft shredders with synchronous drive of the shredding shafts have the main components of shredding tools shown in FIG. 1. These include the two shredding shafts 1 and 3 with the coupling halves 5 and 7. The two shafts have so-called carrying elements 9 and 11 which carry the actual shredding tools. As FIG. 1 shows, these are separating elements and the fangs 13 and 15. The basic bodies of the shredding shafts 1 and 3 additionally have counter separating elements 21 and 23.

FIG. 2 shows only as an example from the patent application PCT/EP2013/066682 (published as WO 2014/026916 A1) two complete shafts with 8 pcs. carrier discs 9 and 11 per shaft 1, and with 8 separating elements 17 and 19 per carrier disc 9 and 11, respectively. The number of the carrier discs 9 and 11 per shaft 1, and the number of the separating elements 17 and 19 per carrier disc 9 and 11, and thus also the counter separating elements 21 and 23, can be varied over a larger range. Thus, shafts 1 with smaller shaft length and small carrier disc diameter starting from four carrier discs 9 and 11 with only three separating elements 17 and 19 per shaft 1 are in use. Or with larger shaft length 1 and 3 and larger carrier disc diameter 9 and 11, up to twelve carrier discs 9 and 11 with up to twelve separating elements 17 and 19 per shaft 1 and 3 are in use. By analogy, the number of the fangs 13 and 15 on the carrier discs 9 and 11 and the number of the counter separating elements 21 and 23 on the shaft base bodies of the shafts 1 and 3 are also changed.

A further main shredding element in FIG. 1 of these dual-shaft shredders is the so-called counter rake 31 and 32 which is equipped with tines 33 and 34 of various design. This counter rake is a component of such dual-shaft shredders. This counter rake once has the task of stripping shredded material which has accumulated between the carrier discs 9 and 11 of the two shafts 1 and 3 during shredding. This is to prevent a once shredded material from getting back between the shredding shafts and being shredded again by them. Since the two shafts also reverse in the event of blockages, i.e. change the rotational direction from to each other to away from each other, unshredded material from the cutting chamber would enter the output stream of the shredded material. This is to be prevented by the counter rake 31 and 32.

The third shredding element is the re-cutting rake 35, which is also referred to as post-crushing beam. This re-cutting rake 35 is available in various designs depending on the shredding task. The dual-shaft shredder described here does not have to be designed with this re-cutting rake. The re-cutting rake 35 also carries additional elements 36. Their design varies according to the task of shredding. The task of the re-cutting rake 35 is to additionally shred the input material after shredding by the separating elements 17 and 19 of the shafts 1 and 3, and to strip already shredded material before the counter rake 31 and 32. In the case of wood and other breakable materials, additional shredding takes place at the re-cutting rake 35 by crushing, from which the other term crushing beam originates. The task of the re-cutting rake is to ensure a smaller and more uniform output grain size from the shredder.

All these three elements of dual-shaft shredders, consisting of the two shafts 1 and 3, the two coupling halves 5 and 7, the two counter rakes 31 and 32, and the re-cutting rake 35, referred to as the so-called shaft system, are installed as shown in FIG. 3A in a complete shredding housing 40, open only at the bottom and top, with the end walls 41 and 42, and the side walls 43 and 44. The two shafts 1 and 3 are preferably supported on the one side in the end wall 41 of the shredding housing 40, and on the other side preferably by mechanically almost rigid couplings 5 and 7 carried by the gearbox fastened to the end wall 42 located on the other side. The counter rakes 31 and 32 are respectively fastened to the side walls 43 and 44. The re-cutting rake 35 is fastened between and under the two shafts 3 and 5 to the end walls 41 and 42 of the shredding housing 40. The two lateral transfer chutes 45 and 46 are permanently fastened to the shredding housing 40 and do not allow access to the shaft system from these two sides.

As shown by the prior-art design and description of such synchronously driven dual-shaft shredders, these can be used very universally and economically for a wide variety of shredding tasks. A suitable shaft system is available for each shredding task of the various input materials, the desired final grain size, the required throughput capacity. The design of all shredding components, the shaft system, consisting of the shafts 1 and 3, the counter rakes 31 and 32 and the re-cutting rake 35, can be adapted to the shredding task.

Unfortunately, the operators of such dual-shaft shredders are not able to do this to an extent that would be technically possible, but which does not seem economically viable in some cases. Since the removal and reinstallation of the shafts 1 and 3, with counter rakes 31 and 32, and the re-cutting rake 35, takes up too much of the service personnel's time, the otherwise economically reasonable conversion work is done without a shaft system that is better suited to the shredding task and the dual-shaft shredder continues to be operated with the shaft system that is unsuitable for the respective shredding task.

On the basis of the following example, the scope of work of the dual-shaft shredders in use according to the current prior art is described in detail when removing and reinstalling the shredding shafts 1 and 3, while retaining the number of the carrying elements 9 and 11, but changing the number or type of separating elements 17 and 19, and using the same re-cutting rake 35. All the following concrete figures are examples of a dual-shaft shredder of medium size.

First of all, the so-called front movable hopper wall 47, which is fastened to the shredding housing 40 and to the front end wall 41, must be removed. A hoist is required for this because the weight does not permit manual removal of the movable hopper wall of approx. 450 kg.

Then the re-cutting rake 35 is lowered onto the conveyor belt located below the shredder using a suitable suspension and hoist. To do this, the service personnel must once go under the shredding housing 40 on the conveyor belt, lying on their backs, and fasten the suspension of the hoist to the re-cutting rake 35. The fastening between the re-cutting rake 35 and the end walls 41 and 42 must then be detached. The re-cutting rake 35 can then be lowered onto the conveyor belt located underneath with a hoist.

As a further step, 20 screws 50 of the two bearing housings 50 of the shafts 1 and 3 must be removed from the end wall 41 and bearing yoke 51. The screws 52 of the bearing yoke 51 can then be removed and the bearing yoke 51 can then be withdrawn with a hoist.

The next step is to remove the two counter rakes 31 and 32 from the shredding housing 40. To do this, 32 screws with which the counter rakes 31 and 32 are fastened to the side walls 43 and 44 must be removed altogether. Then the counter rakes 31 and 32 can be lifted with hoist out of the shredding housing 40.

Then both shafts 1 and 3 are freely accessible. The shafts are then separated from the mechanically almost rigid couplings by means of a suitable device or suspension. This is done by moving the shafts 1 and 3 in the direction of the end wall 41. This separates the coupling halves 5 and 7 on the shaft from the coupling halves on the gearbox of the couplings. Then the shafts 1 and 3 can be lifted out of the shredding housing 40 with the suspension.

The reassembly of another or the same repaired shaft system with the two shafts 1 and 3, the two counter rakes 31 and 32 and the re-cutting rake 35 is then carried out in exactly the opposite sequence to that described here for the removal of the shaft system.

Sliding the two shafts 1 and 3, with the coupling halves 5 and 7 of the shafts, onto the counterpart of the coupling of the coupling halves on the gearbox, is very laborious, time-consuming and subject to a high risk of injury, since the correct position of the shafts with the coupling halves 5 and 7 relative to each other, as well as to the counter couplings on the gearbox of the synchronous drive, is difficult to find, since the coupling halves have a very small fitting tolerance between them.

In addition, however, a considerable amount of time is required for mounting and appropriately aligning the bearing housings 49 on shafts 1 and 3 with the screws 50 on the end wall 41 and bearing yoke 51, if both shafts 1 and 3 are inserted into the shredding housing 40 and the bearing yoke 51 is fastened.

For the medium-size dual-shaft shredders, e.g. with a shaft length of approx. 1800 mm and a flight circle diameter of the shafts [sic] of e.g. approx. 650 mm, and a total weight of approx. 2,200 kg, it takes at least 6-8 hours with 2 service persons, i.e. between 12-16 man-hours, to remove the shafts and reinstall them, while retaining the same counter rake and re-cutting rake in unchanged form.

For the larger size, dual-shaft shredders, e.g. with a shaft length of 2700 mm and a flight circle diameter of e.g. approx. 950 mm and a total weight of approx. 8,500 kg, require at least 12-16 hours with 3 service persons, i.e. between 36-48 man-hours.

If not only the shafts 1 and 3 are replaced by disassembly and reassembly, but also the counter rakes 31 and 32 and the re-cutting rake 35 are replaced, the times of the service personnel specified here will only increase insignificantly, since the counter rakes 31 and 32 and the re-cutting rake 35 must always be disassembled.

This considerable expenditure of time destroys again many of the advantages of these synchronously driven dual-shaft shredders described here, as on the one hand the time for the replacement of the shaft system is missing as production time of the dual-shaft shredder, and as the attempt is made to largely avoid the costs for the service personnel for the shaft replacement.

As a result, the operators of such synchronously driven dual-shaft shredders often fail to install the shaft system best suited to the respective shredding task. Instead, an unsuitable shaft system is used to tackle the shredding task with a considerably higher expenditure of time and greater wear on the unsuitable shaft system.

The situation is similar with the maintenance intervals for reconditioning the shaft system due to wear caused by operation. Here, too, the shaft system is used far beyond the actual maintenance intervals required, as the time and costs for shorter maintenance intervals are avoided once again. Instead, the dual-shaft shredders are used beyond the maintenance interval, although this inevitably requires a lower throughput and thus longer processing times, and also results in disproportionately high further wear on the shaft system, which then requires considerably higher reconditioning costs on the shaft system.

The same situation prevails in the case of damage to the shaft system. Of course, it is unavoidable due to the entry of interfering materials that breakouts occur at the separating elements 17 and 19 or at the fangs 13 and 15. Also damage to the tines 33 and 34 of the counter rakes 31 and 32 cannot be excluded, and damage sometimes also occurs at the re-cutting rake 35 and its attachments 36. Instead of repairing this unavoidable damage immediately, the respective shredding system is still used. This naturally leads to low throughput and longer operating times. The output quality also suffers as a result, as wear at the damaged areas increases, and further damage to the shaft system can occur as a result of the non-repaired damage. All this because one is simply not willing to spend the time expenditure for the removal and reinstallation of the shaft system [and] the repair of the damage.

Often the attempt is made to eliminate such damage without dismantling the shaft system in a makeshift way. This is only possible by the service personnel working in the cutting room of the dual-shaft shredder itself, with the workplace being located directly on the shafts 1 and 3, and the work must in fact be carried out under the feet of the service personnel.

Due to all these concerns, the availability of such dual-shaft shredders with synchronous drive as described here naturally decreases considerably to their economic disadvantage.

A further disadvantage of these dual-shaft shredders with synchronous drive of the shafts according to the current prior art is that the removal of the interfering materials, i.e. input material which cannot be shredded, is only possible under very aggravated conditions. For this it is often indispensable that the operating personnel must enter the shredding area of the shredder and step on the shredding shaft in order to remove the interfering material. Such measures again reduce the availability.

It should not go unmentioned that the work involved in changing, maintaining and repairing the shaft system according to the current prior art for dual-shaft shredders requires partly unreasonable work on the part of the service personnel and partly involves an increased risk of injury.

DETAILED DESCRIPTION OF THE INVENTION

It is therefore the object of the invention to at least partially overcome the aforementioned disadvantages of the prior art.

This object is achieved by a shredding device according to claim 1. Advantageous developments are defined in the claims dependent on it.

The shredding device according to the invention comprises: two shredding shafts arranged parallel to each other with shredding elements arranged thereon, wherein the shredding shafts are preferably rotatable mechanically synchronized to each other; a shaft-side coupling element which is connected to a respective first end of the shredding shafts; and a housing with a housing-side coupling element which can be coupled to the shaft-side coupling element. The shredding device according to the invention is characterized by a displacement device which causes a displacement of the shredding shafts for the decoupling and coupling of the shaft-side coupling element from or to the housing-side coupling element. With the displacement device (as part of the shredding device), the two shredding shafts designed for synchronous operation can be displaced as a unit in order, for example, to change the shafts. Therefore, according to the invention, there is no need for an external displacement device which is necessary according to the prior art. The shafts are synchronized on the drive side.

According to a development of the shredding device according to the invention, the housing-side coupling element and the shaft-side coupling element can have complementary centering elements. This makes it easier to bring the two coupling elements together and align them.

Another development is that a coupling-side housing wall can be double-walled and undivided. In this way, there is an intermediate space into which parts of the input material penetrating from the shaft side can fall without further reaching the coupling elements. Since the shredding shafts can be moved with a sufficiently large stroke by means of the displacement device, it is therefore not necessary to divide the shaft-side wall of the double-walled housing wall in order to enable a partial surface to be removed, which would allow a way of lifting the shafts.

According to another development the shredding device may further comprise: an end wall in which two bearing housings are provided for supporting a respective second end of the shredding shafts, wherein the second ends are opposite to the first ends in the axial direction of the shredding shafts, and wherein the end wall is detachably fastened to the housing and is mountable and removable as a dual-shaft assembly of end wall and shredding shafts. This has the advantage that the arrangement of the end wall (with the bearing housings) and the shredding shafts (with the shaft-side coupling element) is stable in relation to the relative position to each other and can be moved and exchanged as a unit.

In another development, the shredding device may further comprise a hopper wall of a feed hopper, wherein the hopper wall is coupled to the end wall and pivotally provided about an axis to effect decoupling or coupling of the shaft-side coupling element from or to the housing-side coupling element upon pivoting of the hopper wall, wherein the pivoting of the hopper wall in particular causes the dual-shaft assembly to be displaced in the axial direction of the shredding shafts and the shaft-side coupling element to be pulled off or pushed forward from or towards the housing-side coupling element, wherein the end wall is supported on the housing after the pulling off or before the pushing forward. The hopper wall is included in this development in the displacement device. Due to the support of the end wall on the housing, an external mounting is not necessary.

Another development consists in the fact that the shredding device can further comprise at least one maintenance flap of the housing, which is arranged along the shafts and can be folded out about an axis of rotation preferably extending parallel to the shredding shafts, wherein preferably two such maintenance flaps are arranged on opposite sides of the housing.

This can be further developed in such a way that a counter rake can be fastened to an inside of the at least one maintenance flap or [the maintenance flap] can be formed with counter rake as a unit, the tines of which engage between the shredding elements on the shredding shafts. In this way, the counter rake is folded out together with the maintenance flap.

The maintenance flap can be held on the housing by means of a lock. This allows the maintenance flap to be changed quickly by unlocking the lock, for example by shifting a bolt which also serves as a rotary axis.

In another development, a re-cutting rake or crushing beam can also be provided in the housing, which is designed for the additional shredding of input material already shredded by the shredding shafts, wherein the re-cutting rake or crushing beam is located underneath the shredding shafts and is pivotable out of the housing in the direction of the open maintenance flap by means of a pivot device. By means of the pivot device, the re-cutting rake can be easily moved forward and/or out.

Parts that prevent the re-cutting rake from pivoting out can be moved beforehand or together with the re-cutting rake in such a way that a pivoting out is possible. In particular, lateral hopper plates, for example, can be folded away to expose the space below the shafts.

The re-cutting rake can be fastened to the end wall of the dual-shaft assembly and to an opposite end wall of the housing by means of a respective fastening device, the fastening device preferably comprising displaceable elements. Thus, the re-cutting rake can be easily removed or replaced.

The invention also provides a shredding system comprising a shredding device according to the invention with the dual-shaft assembly or one of its developments as well as a changing device for gripping, holding and transporting the dual-shaft assembly. With the changing device (for example in the form of a gripper arm), the dual-shaft assembly can be removed out of the housing after withdrawal from the housing-side coupling element caused by the displacement device. The dual-shaft assembly is installed in the reverse order.

This can be further developed so that the gripper can have retaining brackets that can be positioned around the shredding shafts. The retaining brackets can be used to grip the shafts, preferably in a space between the shredding elements.

Another development of the shredding system is that a height-adjustable support device, also referred to herein as an adjustable support foot 121, can be provided at a coupling-side end of the housing on which the changing device can rest in order to enable a height-defined position of the dual-shaft assembly when changing the dual-shaft assembly. This allows precise positioning of the shafts during installation, especially when coupling the shaft-side and housing-side coupling elements.

Further features and exemplary embodiments as well as advantages of the present invention are explained in more detail below on the basis of the drawing. It goes without saying that these embodiments cannot exhaust the entire scope of the present invention. It also goes without saying that some or all of the features described below can also be combined in other ways.

EMBODIMENTS

It is the object of the invention to largely eliminate the above-mentioned disadvantages of the prior art in order to make better use of the advantages of this dual-shaft shredding system described here. This is achieved by considerably reducing the time required to change the shaft system. The time required for maintenance and repair work is also considerably reduced. The same goes for the fact that the performance of such work is considerably facilitated and technically safer for the service personnel.

This enables the operator of such synchronously driven dual-shaft shredders to install in the shredder the shaft system which is best suited to the respective task of shredding, consisting of shredding shafts, counter and re-cutting rakes, as the time required and thus the costs for removal and reinstallation are considerably less than the economic advantage resulting from operation with the respectively most suitable shaft system in terms of costs and throughput capacity.

It also makes it easier for the operator of such dual-shaft shredders to comply with the economically advantageous maintenance intervals for the reconditioning of the shafts, counter and re-cutting rakes. This not only reduces costs but also increases throughput.

The operator of such synchronously driven dual-shaft shredders can also react immediately to damage to parts on the shaft system, such as broken-out knives or pre-shredders, and immediately repair them without any additional time being required.

This invention also considerably increases the availability of the dual-shaft shredding system, which again makes a considerable contribution to increasing economic efficiency.

The fact that the removal of interfering materials, i.e. non-shreddable input material, is very easy and quick with the solution according to the invention, without the operating personnel having to go into the dual-shaft shredder, also contributes to increasing availability.

The object according to the invention is achieved by a mobile or stationary dual-shaft shredding device with synchronous drive of the two shredding shafts, wherein the shredding device according to the invention comprises: two shredding shafts arranged parallel to each other with shredding elements arranged thereon; a shaft-side coupling element connected to a respective first end of the shredding shafts; and a housing with a housing-side coupling element which can be coupled to the shaft-side coupling element. The shredding device according to the invention is characterized by a displacement device 200 which causes a displacement of the shredding shafts for decoupling and coupling of the shaft-side coupling element from or to the housing-side coupling element.

Figure 1:
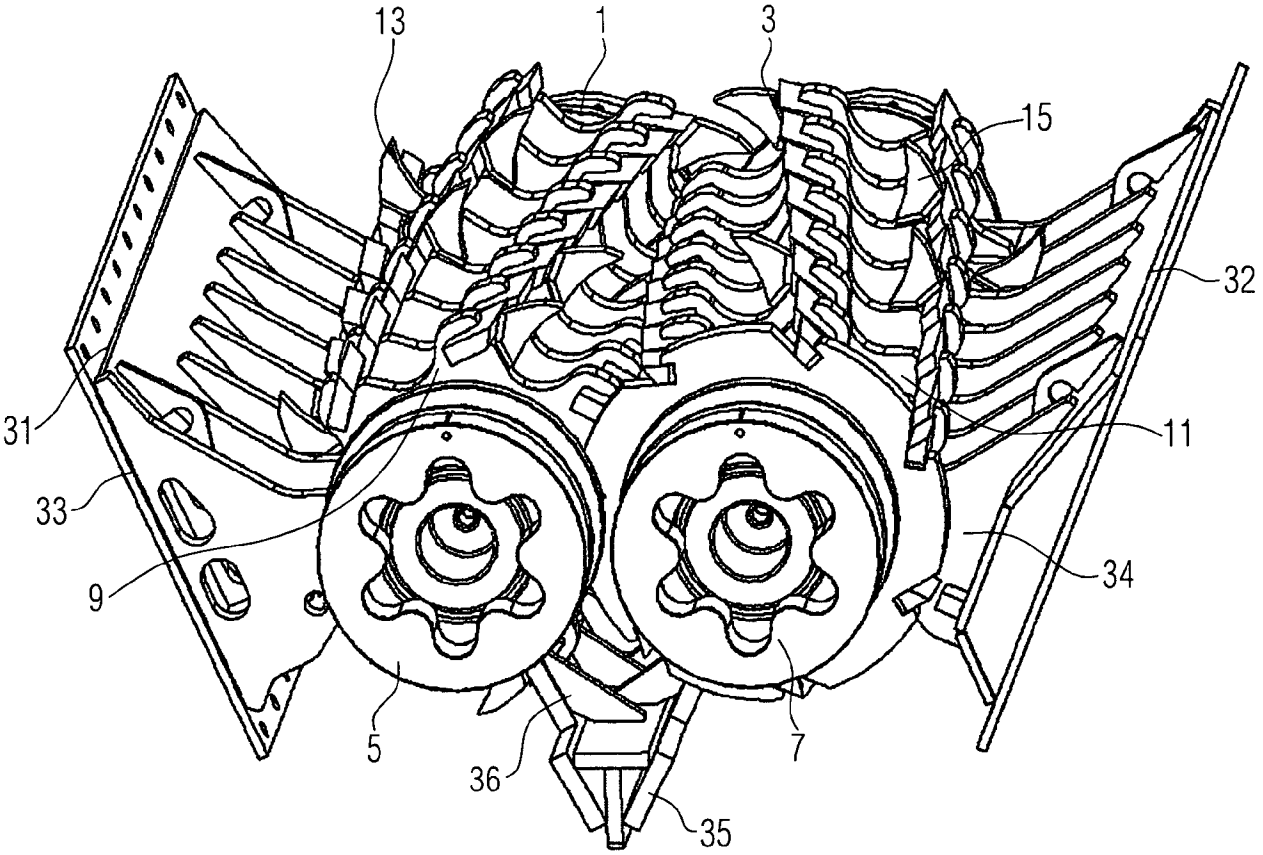
FIGS. 1-3 show the prior art.
Figure 2:
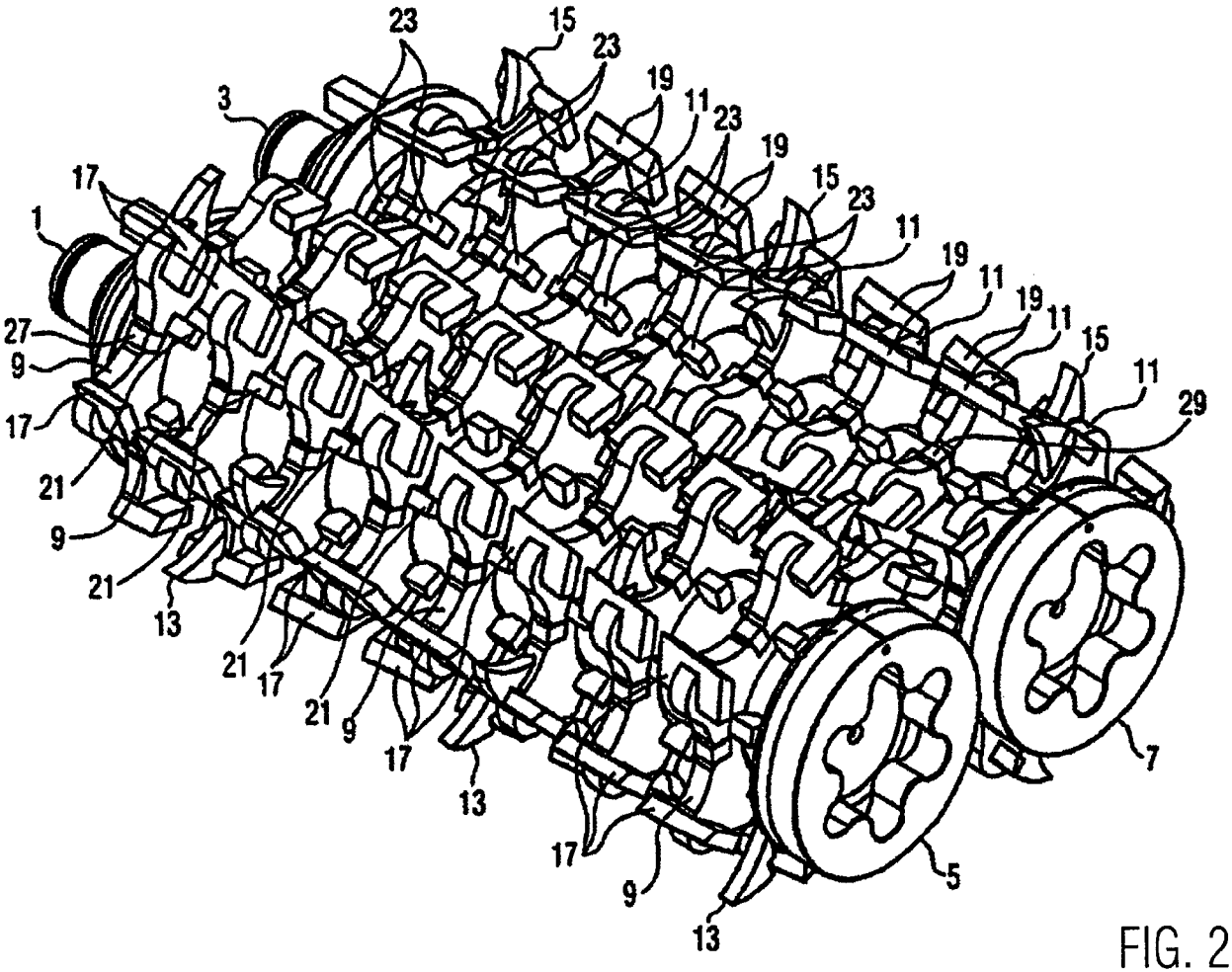
Figure 3A:
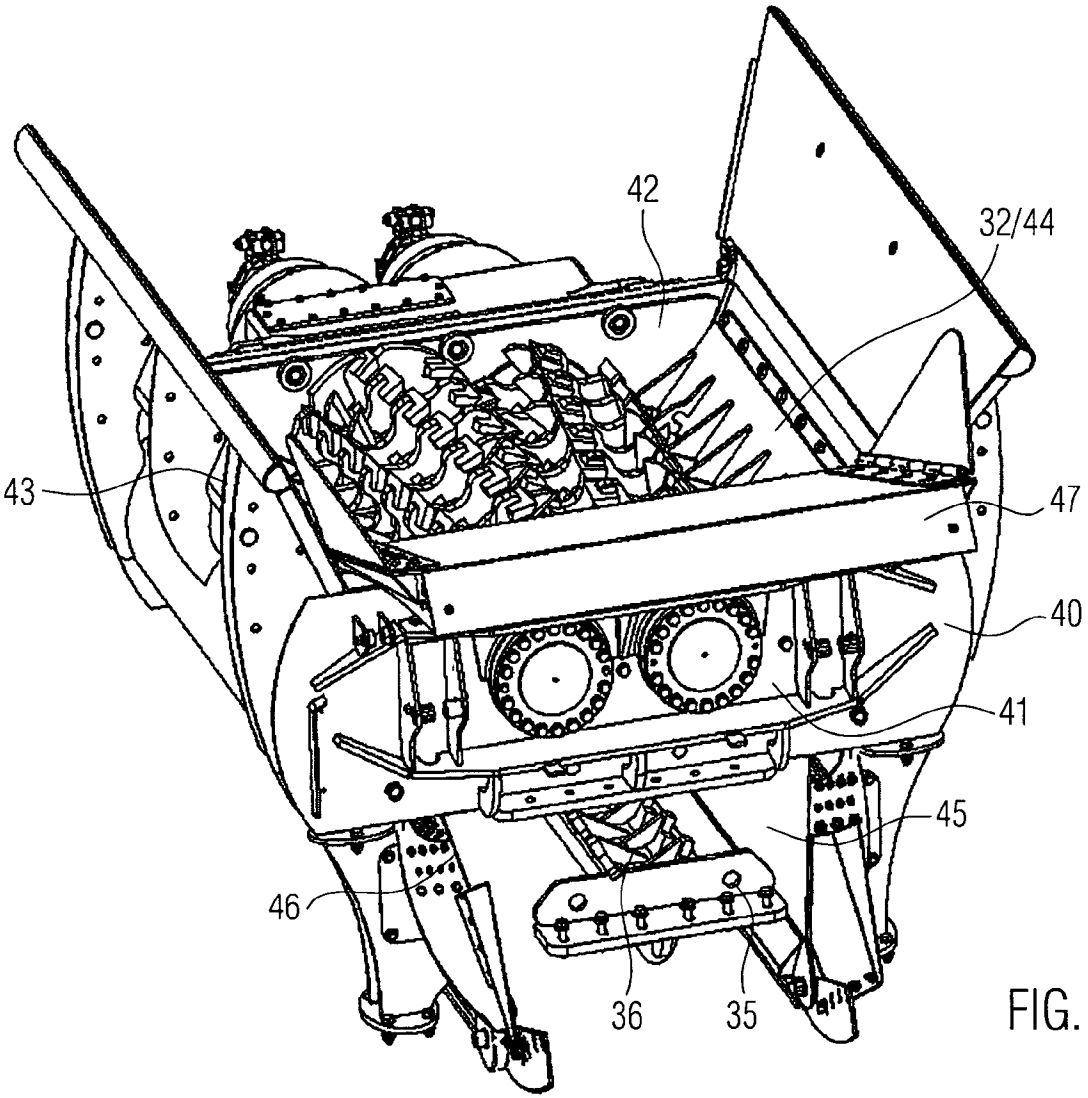

In the case of dual-shaft shredders with synchronous drive of the shredding shafts, the two side walls 43 and 44 in FIG. 3A, which also carry the two counter rakes 31 and 32 (FIG. 3A), are firmly connected to the housing (shredding housing) 40 (FIG. 3A) according to the previous prior art and cannot be opened.

Figure 4:
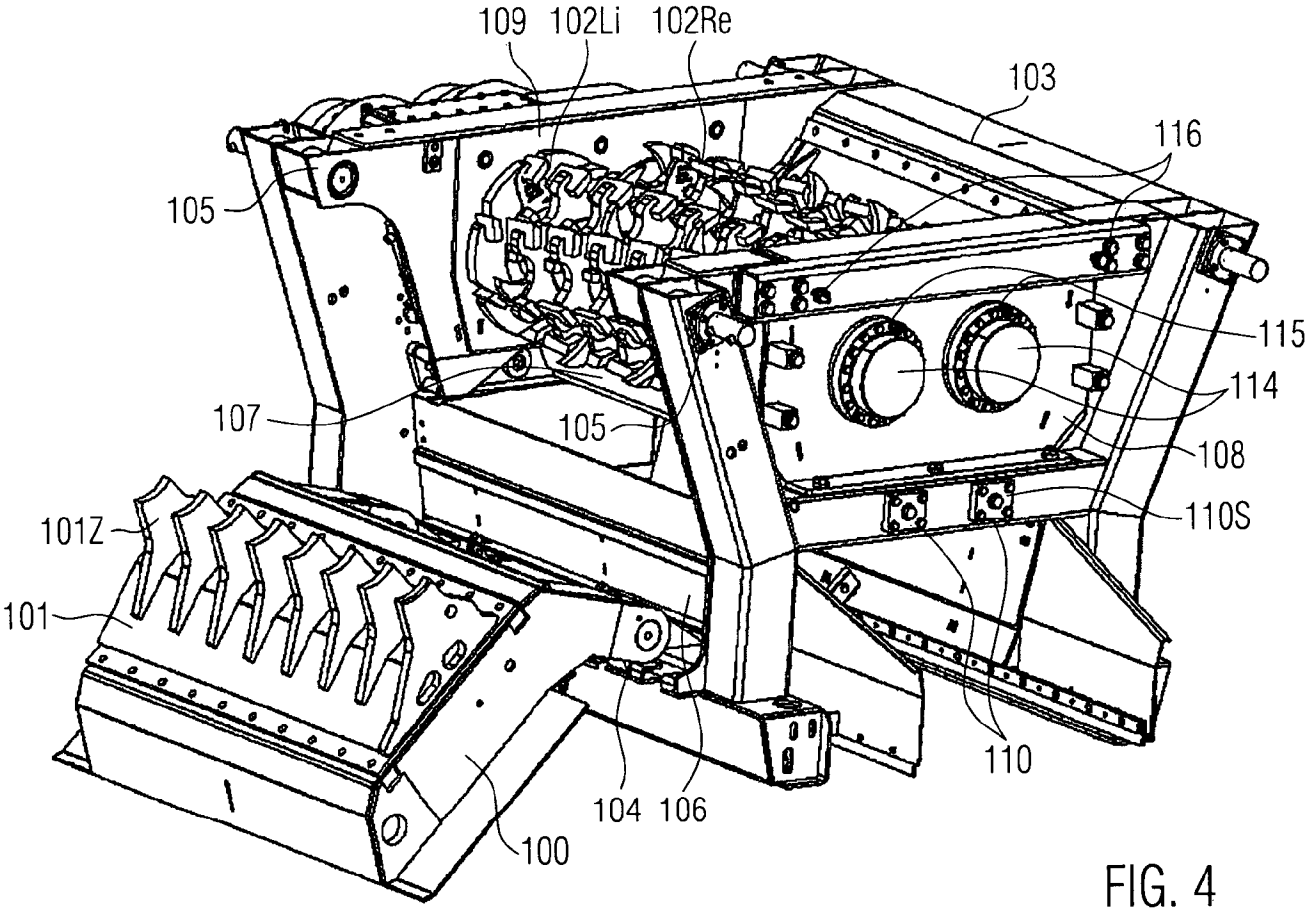
FIGS. 4-10 show an embodiment of the dual-shaft shredder according to the invention.

To implement the task according to the invention, the dual-shaft shredder according to FIG. 4 is equipped with two maintenance flaps or pivot-out walls 100, which are pivoted out or folded down downwards. The counter rakes 101 are also fastened to the maintenance flap 100; they are designed similarly to the counter rakes 31 and 32 in FIG. 3A. By replacing the side walls 43 and 44 of FIG. 3A with the maintenance flaps 100, the shafts 102 are easily accessible for the performance of maintenance work after opening and pivoting out the maintenance flap 100. Due to a very good working position, the counter rake 101 is also accessible for carrying out maintenance work, which was previously not possible according to the prior art, as the counter rakes 31 and 32 in FIG. 3A had previously to be removed completely.

To this end the maintenance flap 100 is fastened at the bottom of the shredding housing 103 in a bearing 104. Other embodiments of a movable fastening form are also possible.

The fastening of the maintenance flap 100 in the working position is carried out on the shredding housing 103 preferably by means of a hydraulically operated locking unit 105. Other embodiments of the locking device with a different type of actuation, e.g. manual or electric actuation, are also possible in a development of the invention.

In a further development of the embodiment according to the invention, it is also conceivable not to pivot out or fold the maintenance flap 100 downwards or down, but to lift it upwards or pivot it out sideways.

In another embodiment of the development according to the invention, the maintenance flap 100 is not held by a bearing of the maintenance flap 104 on the lower side on the shredding housing 103, but also by a locking unit 105, as it is used for locking the maintenance flap on the upper side on the shredding housing 103 in the working position.

This makes it possible to quickly, simply and easily remove and reinstall the maintenance flap 100, and thus also to easily replace the counter rake 115 fastened to the maintenance flap 100, in the event of a shaft replacement.

In a further embodiment of the development according to the invention, the maintenance flap 100 can already be designed in such a way that it contains the elements of the counter rake 101 with tines 101Z. The maintenance flap 100 is therefore an inseparably connected unit with the counter rake 101.

A further advantage of the design according to the invention with the maintenance flaps 100 is that the removal of so-called interfering materials, i.e. unshreddable input materials, can be easily carried out. If the shafts 102 are blocked by interfering materials, the shredder is stopped. The side walls of the outlet chute 106 are lowered inwards to cover the conveyor belt, the maintenance flaps 100 with the counter rake 101 are opened and the shafts 102 of the shredder are operated in reverse operation, i.e. in the direction of rotation of the shafts 102 not to each other but from each other, until the interfering material is ejected from the shredding housing 103.

According to the prior art, the side walls of the transfer chutes 45 and 46 in FIG. 3A are firmly connected to the shredding housing 40 (FIG. 3A). The side walls of the transfer chute 106 are movable due to the design according to the invention. Due to the movable design of the transfer chute 106, it can be folded under the shafts 102 or outwards away from the shafts.

According to the preferred embodiment of folding the side wall of the transfer chute 106 under the shafts 102, a cover is also created for the conveyor belt located underneath so that it is not damaged during maintenance work.

Only by folding the side wall of the transfer chute 106, both under the shaft 102 and outwards away from the shafts 102, an opening is created to the re-cutting rake or crushing beam 107.

The side wall of the transfer chute 106 can be operated in both directions of movement, manually, hydraulically, pneumatically or electrically, as well as in all other operating modes.

As was the case with the prior-art dual-shaft shredders with synchronous drive of the shredding shafts, the re-cutting rake 35 FIG. 3A with the attachments 36 can only be removed from the shredding housing 40 with considerable effort to change the shafts.

With the former prior art, the re-cutting rake 35 in FIG. 3A is fastened to the two end walls 43 and 44 of the shredding housing 40.

For the fastening of the re-cutting rake 107, a fastening to the end walls 108 and 109 of the shredding housing 103 was also chosen in the solution according to the invention.

Figure 5:
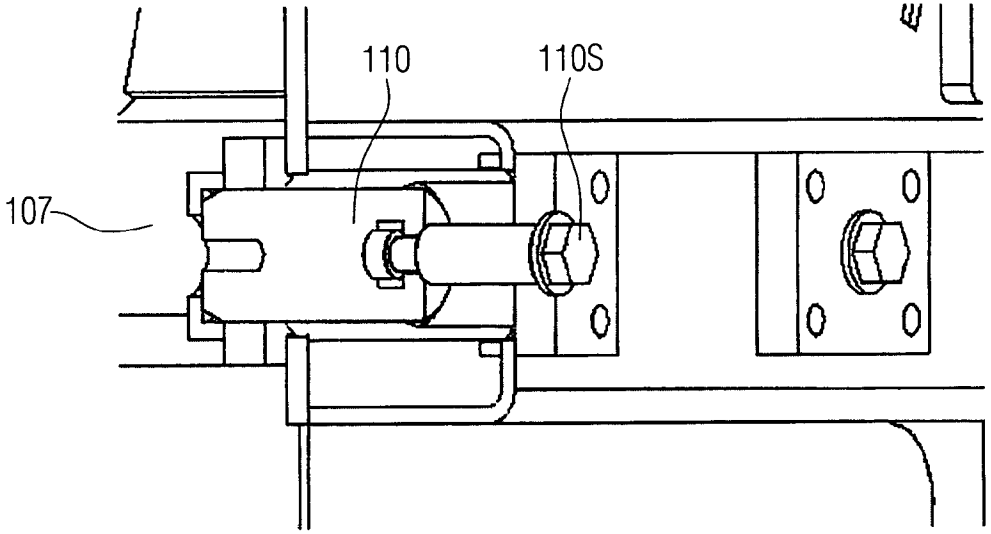

However, the fastening is not carried out, as with the prior art, by different types of screw connections, but in one embodiment, such as preferably by a quickly releasable form of a sliding and securing bolt 110, as shown in FIG. 5. The sliding and securing bolts 110 are preferably actuated mechanically by turning threaded screws.

Figure 6:
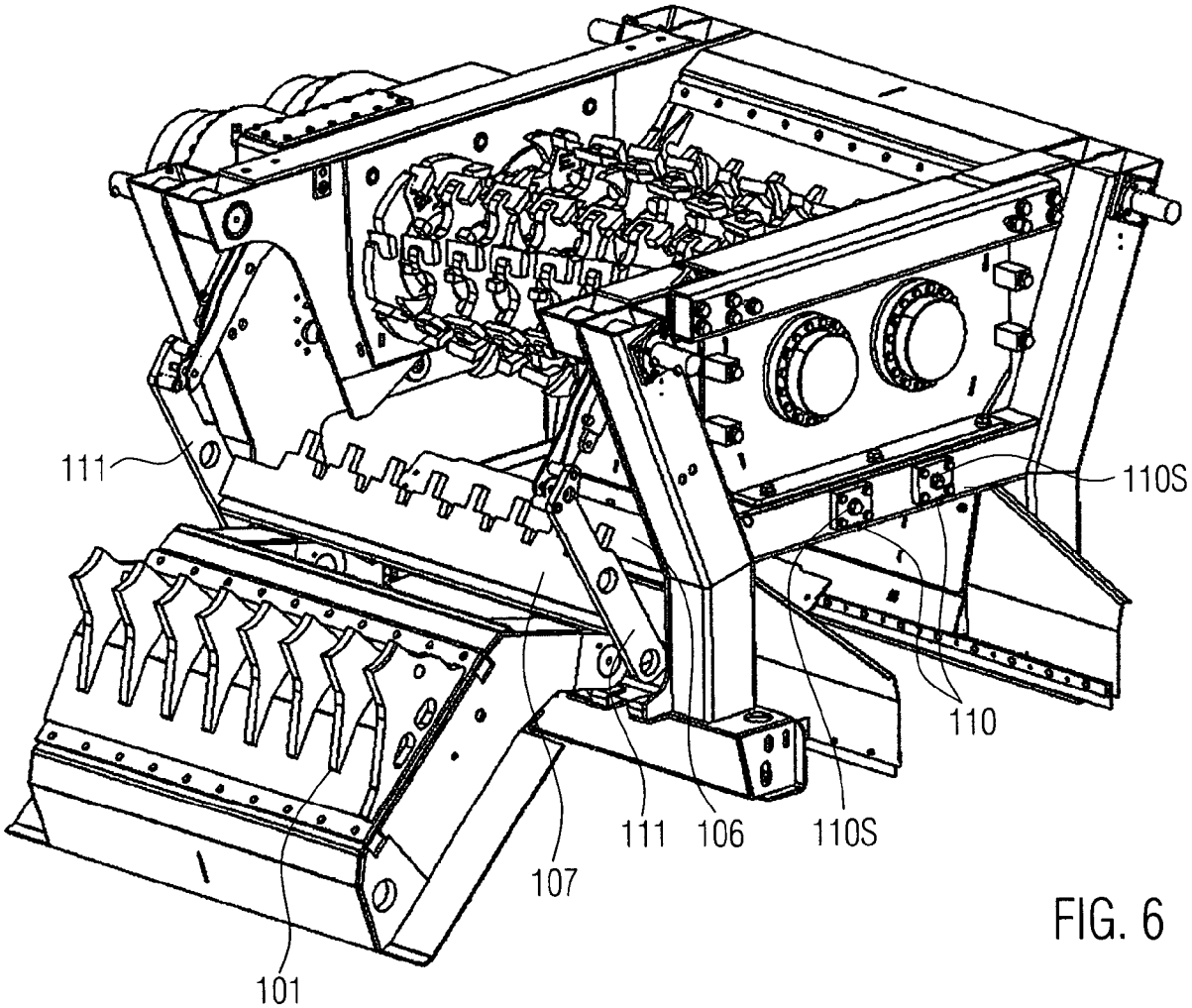
Figure 7:
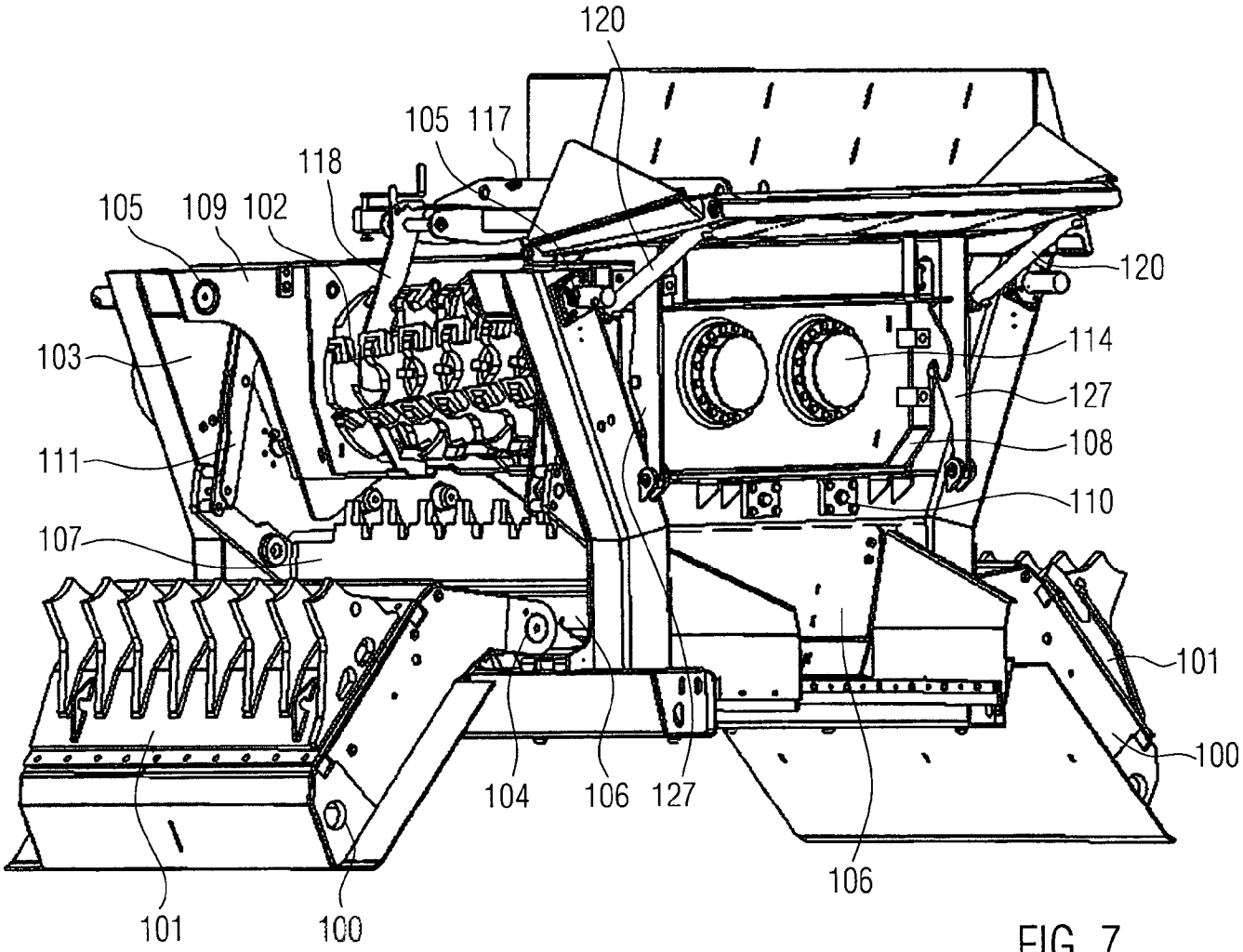

This inventive object of easier removal of the re-cutting rake 107, in addition to the easily detachable fastening with sliding and securing bolts 110, is also achieved by the fact that the re-cutting rake is fastened to a movable pivot device 111 according to FIG. 4. As FIG. 6 shows, this device allows to move the re-cutting rake 107, under the shafts 102, through the opening created by folding down the side wall of the transfer chute 106, to the outside of the shredding housing 103, above the opened maintenance flap 100.

For the design of the pivot device 111, all embodiments are conceivable which make it possible to move the re-cutting rake 107 out of the shredding housing 103 through the opening created by folding down the transfer chute 106.

In a development of the embodiment according to the invention it is also possible to design the side walls of the transfer chute 106 in such a way that they can be moved together with the re-cutting rake 107 with a pivot device 111 under the shafts 102 to outside the shredding housing 103.

Figure 8:
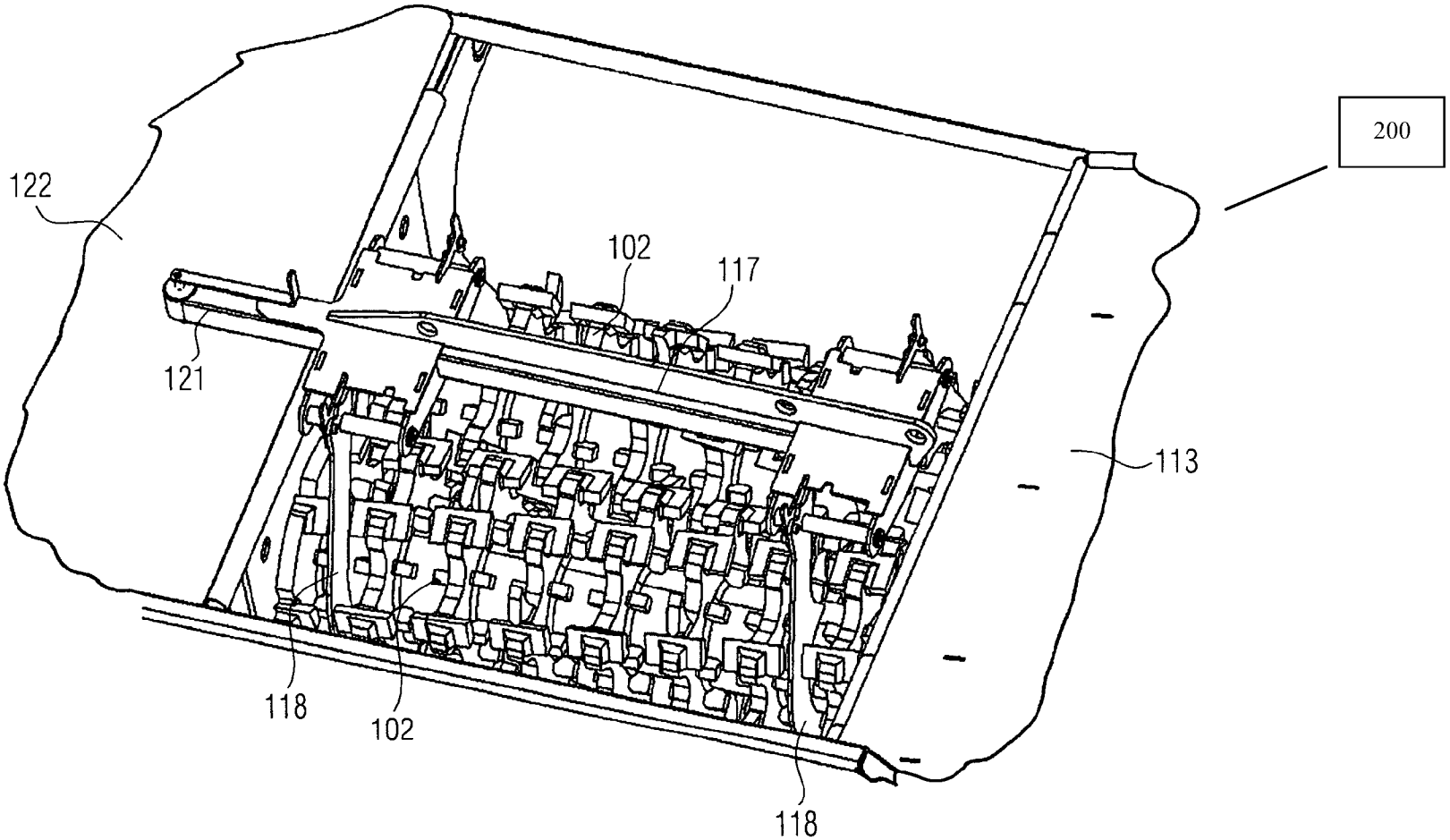

Compared to the prior art, the actual removal of the shafts 102 out of the shredding housing 103 has been further developed decisively according to the invention. FIG. 8 shows the side of the bearing of the shafts 102 in the end wall 108 and the movable hopper wall 113.

The movable hopper wall 47 from FIG. 3A must be removed according to the prior art for shaft replacement. This is no longer necessary with the design according to the invention. The movable hopper wall 113 can remain completely in the dual-shaft shredder. All types and shapes of the design of the hopper wall 113 are conceivable that do not require the removal of the hopper wall 113 to replace the shafts.

Figure 3B:
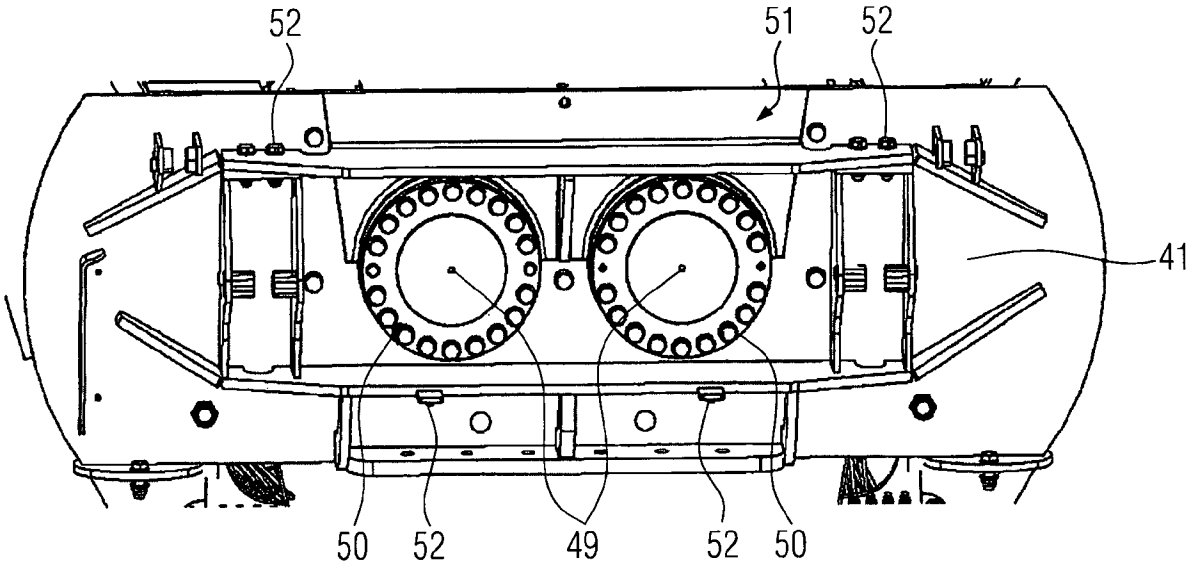

Contrary to the prior art with the bearing yoke 51 in FIG. 3B, the end wall 108 is designed in such a way that the two bearing housings 114 are fastened to it. The bearing housings 114 are fastened by the screws 115, which however do not have to be removed to dismount the shafts 102. The end wall 108 is not, as with the current prior art, inseparably connected to the shredding housing 107, but can be detached from it by removing the screws 116.

The shaft change of the two shafts 102 is therefore carried out together with the end wall 108 with the two bearing housings 114 and the shafts 102 supported therein, without having to separate the bearing housings 114 from the end wall 108.

Other embodiments are also possible in a development of the method according to the invention, which no longer requires the removal of the bearings, preferably a bearing housing or something similar to 114, from the shafts 102 or the end wall 108 when the shafts are removed from the dual-shaft shredder.

When all the screws 116 of the fastening of the end wall 108 with the bearing housing 114 on the shredding housing 103 have been removed, the shaft pair together with the end wall 108 can be removed from the dual-shaft shredder.

As FIG. 8 shows as a plan view of the shafts 102 still installed, a lifting and transporting device 117 must first be attached to the shaft pair 102. This device engages with retaining brackets 118 in the shafts 102 and thus secures the shafts for safe removal from the dual-shaft shredder and for subsequent transport.

After attachment of the device 117 the shafts 102 are still held by the bearings in the bearing housing 114 in the end wall 108 on the one side and on the other side by the shaft coupling halves 119W on the shafts and 119G on the gearbox.

To be able to remove the shafts 102 with the device 117 from the dual-shaft shredder, first the coupling connection 119 must be loosened, which consists of the one coupling half 119W on the shaft 102 and of the other coupling half 119G on the drive side.

Figure 9:
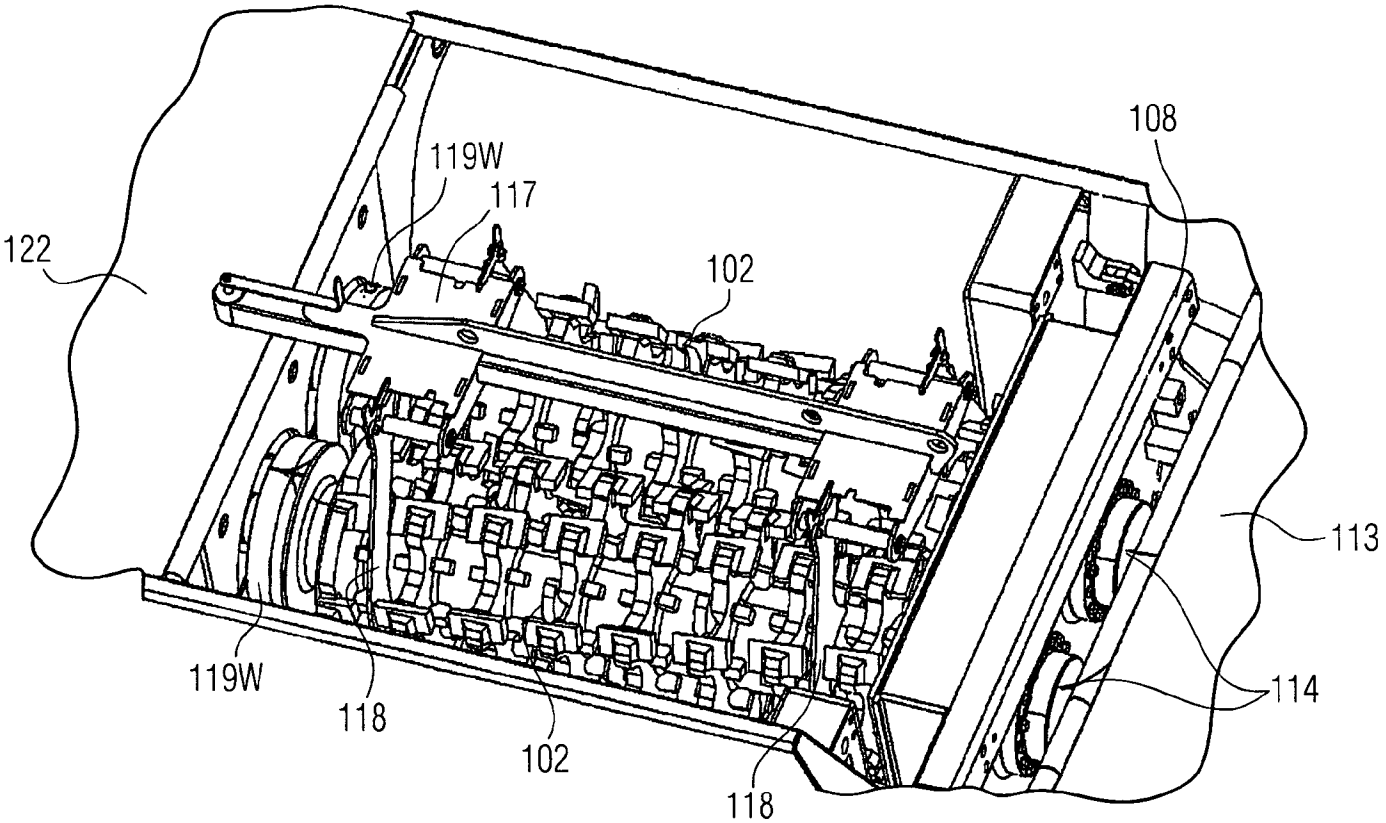

For this purpose, the hopper wall 113, which has a nearly upright position in the working position, is pressed down with the cylinders 120 and the pivot device 127. As FIG. 9 of a plan view with displaced shaft 102 shows, the shaft pair 102, with the end wall 108 and the bearing housings 114, is thereby displaced in the direction, and the shaft is thereby pulled off from the coupling 119, in which the hopper wall 113 and the pivot device 127 is pivoted forwards and downwards.

Further designs are conceivable in the development of the device according to the invention, which ensure that the shaft pair 1021*i* and 102*re*, each equipped with the coupling halves 119W, are removed from the coupling halves 119G, thus releasing or separating the coupling 119.

After this operation, the shaft pair 102 is supported on the one side with the end wall 108 on the shredding housing 103. On the other side, the shaft pair 102 is held by the lifting and transporting device 117, which is supported with an adjustable support foot 121 on the tilting hopper 122.

The shaft pair 102 is then free for removal with a suitable hoist from the dual-shaft shredder. Up to this point, no hoist was required except for the insertion of the device 117 into the shaft pair 102.

The method according to the invention can be further developed in further embodiments, which once allows the shaft pair 102 to be pulled off from the coupling 119 within the dual-shaft shredder, and the necessary force of actuation of devices of any kind located on or within the dual-shaft shredder is applied.

A development of the method according to the invention is also made possible by the fact that suitable measures of any kind ensure that the shaft pair 102 does not require any mounting or support outside the dual-shaft shredder when displacing and pulling off from the couplings 119.

For a better understanding, the shaft change already described according to the prior art is described as follows, also according to the inventive design of the quick-change method, wherein the same prerequisites have been selected. That is simple shaft replacement 102, without replacement of the counter rakes 101 and re-cutting rakes 107.

For this purpose, the maintenance flap or pivot-out wall 100 must first be detached from the shredding housing 103 by means of the locking device 105. Then the maintenance flap 100 together with the counter rake 101 can be pivoted downwards and outwards or folded.

Then the sliding and securing bolts 110 of the re-cutting rake 107 are pulled out of the re-cutting rake 107 in a preferred embodiment with the screws 110S, thus releasing the re-cutting rake for removal. The side wall of the outlet chute 106 is then folded downwards, creating a continuous opening under the shafts 102. Through this opening, the re-cutting rake 107 can then be pivoted outwards with the pivot device 111.

Then the screws 116 of the end wall 108 are loosened. This end wall contains the bearing housings 114 which are fastened to the end wall 108 with the screws 115, but which do not have to be removed.

The next step is to place the lifting and transporting device 117 on the two shafts 102 and secure it to them. The device 117 is supported with plural retaining brackets 118 on the shafts 102 and with the support foot 121 on the tilting hopper 122.

Now the shaft pair 102 can be displaced by lowering the hopper wall 113, which is done by actuating the cylinder 120, and the shafts 102 can be pulled off the couplings 119 and thus released. The shaft pair 102 can then be removed with the device 117 with a suitable hoist from the shredding housing 103.

The shafts are then installed in the reverse order of the work steps listed here. For the medium size of a dual-shaft shredder, only 0.5-1 man-hour is required as the time for changing the shafts, compared with 12-16 man-hours in the current prior art. For the larger series, the time required is approx. 1-2 man-hours, compared with 26-48 man-hours in the current prior art.

These times in the embodiment according to the invention refer only to the replacement of the shafts 102, but retain the counter rake 101 and the re-cutting rake 107.

Even if not only the replacement of the shafts 102 is carried out, but also the replacement of the counter rake 101 and the re-cutting rake 117 is carried out during shaft change, these times are only slightly extended when the embodiment is used according to the invention, with a support of the maintenance flap 100 with a locking unit 105 instead of in a bearing unit 104, and the maintenance flap 100 with the counter rake 101 in one unit.

The other disadvantages according to the prior art in the installation of the shafts 1 and 3 in connection with the coupling, or the coupling halves 5 on the shaft, and the coupling half 7 on the gearbox, could also be eliminated with the method according to the invention.

Figure 10:
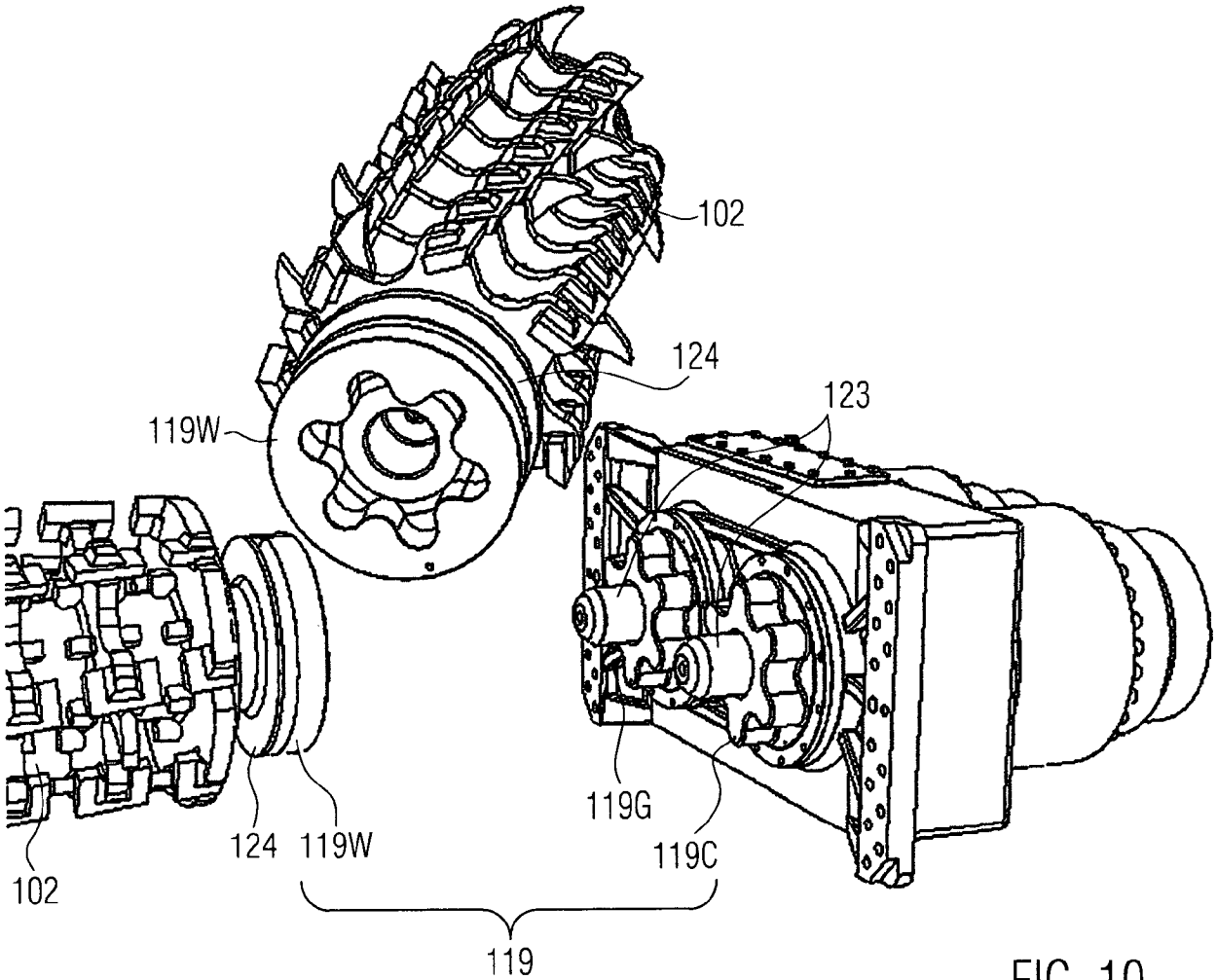

FIG. 10 shows a view in the area of the coupling 119, with the coupling halves 119W on shaft 102, with one shaft 102 having been arranged offset for a better view, and the coupling half 119G on the drive side. This shows the tight fitting tolerance between both coupling halves. To make it easier to slide the shaft 102 with the coupling half 119W onto the coupling half 119G, the coupling half 119G was equipped with an additional centering pin 123. In the shaft 102 with the coupling half 119G, a bore was provided to accommodate the centering pin.

When installing the shafts 102 with the coupling half 119W and sliding onto the coupling half 119G, the shaft is first centered with the centering pin 123. Then it is very easy to check the position of the shafts in relation to each other and correct it if necessary. Subsequently, the shaft with the coupling half 119W can be completely pushed onto the coupling half 119G and thus a force-fit connection can be created.

All other possibilities of the shaft centering are conceivable in a development of these methods according to the invention, such as a pin in the shaft or a pin which extends through a gearbox into the shaft on the drive side and can be displaced.

The method according to the invention for the quick change of shredding shafts on dual-shaft shredders has brought a further advantage over the prior art. By displacing the shafts 102 with the cylinder 120 of the hopper wall 113, a larger displacement path could be achieved. This made it possible to achieve a greater distance between the sealing of the shaft with the sealing ring 124 with the bulkhead wall and the end wall 109 on the drive side. This virtually prevents the penetration of foreign bodies into the sealing of the drive side, as they should pass through the sealing between the sealing ring 124 and the bulkhead wall.

The use of this greater distance as bulkhead space is only possible with prior-art dual-shaft shredders if a divided bulkhead wall is provided.

The embodiments shown are only exemplary and the complete scope of the present invention is defined by the claims.

The invention claimed is:

1. A shredding device, comprising:

two shredding shafts arranged parallel to each other with shredding elements arranged thereon, wherein the shredding shafts are rotatable mechanically synchronized to each other;

a shaft-side coupling element which is connected to a respective first end of the shredding shafts;

a housing with a housing-side coupling element which is coupled to the shaft-side coupling element;

a displacement device enabling and causing displacement of the shredding shafts for decoupling and coupling the shaft-side coupling element from or to the housing-side coupling element;

an end wall in which two bearing housings are provided for supporting a respective second end of the shredding shafts;

wherein the second ends are opposite to the first ends in the axial direction of the shredding shafts;

wherein the end wall is detachably fastened to the housing and is installed and removed as a dual-shaft assembly of end wall and shredding shafts;

wherein the displacement device is coupled to the end wall in order to effect decoupling and coupling of the shaft-side coupling element from or to the housing-side coupling element, wherein the displacement device effects displacement of the dual-shaft assembly in the axial direction of the shredding shafts and withdrawal of the shaft-side coupling element from the housing-side coupling element; and wherein the displacement device comprises a hopper wall of a feed hopper, and wherein the hopper wall is coupled to the end wall and is provided pivotably about an axis in order to effect decoupling and coupling of the shaft-side coupling element from or to the housing-side coupling element when the hopper wall is pivoted, wherein the pivoting of the hopper wall causes a displacement of the dual-shaft assembly in the axial direction of the shredding shafts and a withdrawal of the shaft-side coupling element from the housing-side coupling element.

2. The shredding device according to claim 1, wherein the housing-side coupling element and the shaft-side coupling element have complementary centering elements.

3. The shredding device according to claim 2, wherein a coupling-side housing wall is double-walled and undivided.

4. A shredding system comprising:

the shredding device according to claim 2; and a changing device for gripping, holding and transporting the dual-shaft assembly.

5. The shredding device according to claim 1, wherein a coupling-side housing wall is double-walled and undivided.

6. A shredding system comprising:

the shredding device according to claim 5; and a changing device for gripping, holding and transporting the dual-shaft assembly.

7. The shredding device according to claim 1, wherein the housing comprises at least one maintenance flap that is arranged along the shafts and is foldable about an axis of rotation extending parallel to the shredding shafts.

8. The shredding device according to claim 7, wherein a counter rake is fastened to an inside of the at least one maintenance flap or the maintenance flap is formed with counter rake as a unit, wherein the counter rake comprises one or more tines which engage between the shredding elements on the shredding shafts.

9. A shredding system comprising:

the shredding device according to claim 8; and a changing device for gripping, holding and transporting the dual-shaft assembly.

10. The shredding device according to claim 7, wherein the maintenance flap is held on the housing by means of a lock.

11. The shredding device according to claim 7, wherein a re-cutting rake or crushing beam is further provided in the housing, wherein the re-cutting rake or the crushing beam performs additional shredding of input material already shredded by the shredding shafts, wherein the re-cutting rake or crushing beam is located below the shredding shafts and is pivotable out of the housing in the direction of the at least one maintenance flap in an opened state by means of a pivot device.

12. The shredding device according to claim 11, wherein parts which impede a pivoting out of the re-cutting rake are moved beforehand in such a way that a pivoting out is possible or wherein parts which impede a pivoting out of the re-cutting rake are moved together with the re-cutting rake in such a way that a pivoting out is possible.

13. The shredding device according to claim 11, wherein the re-cutting rake is fastened to the end wall of the dual-shaft assembly and to an opposite end wall of the housing by means of a respective fastening device, wherein the fastening device comprises displaceable elements.

14. A shredding system comprising:

the shredding device according to claim 7; and a changing device for gripping, holding and transporting the dual-shaft assembly.

15. A shredding system comprising:

the shredding device according to claim 1; and a changing device for gripping, holding and transporting the dual-shaft assembly.

16. The shredding system according to claim 15, wherein the changing device comprises retaining brackets which is positioned around the shredding shafts.

17. The shredding system according to claim 15, further comprising:

a height-adjustable support device at a coupling-side end of the housing on which the changing device can rest to enable a height-defined position of the dual-shaft assembly when the dual-shaft assembly is changed.

18. A shredding device, comprising:

two shredding shafts arranged parallel to each other with shredding elements arranged thereon, wherein the shredding shafts are rotatable mechanically synchronized to each other;

a shaft-side coupling element which is connected to a respective first end of the shredding shafts;

a housing with a housing-side coupling element which is coupled to the shaft-side coupling element;

a displacement device enabling and causing displacement of the shredding shafts for decoupling and coupling the shaft-side coupling element from or to the housing-side coupling element;

wherein the housing comprises at least one maintenance flap that is arranged along the shafts and is foldable about an axis of rotation extending parallel to the shredding shafts;

wherein a re-cutting rake or crushing beam is further provided in the housing, wherein the re-cutting rake or the crushing beam performs additional shredding of input material already shredded by the shredding shafts, wherein the re-cutting rake or crushing beam is located below the shredding shafts and is pivotable out of the housing in the direction of the at least one maintenance flap in an opened state by means of a pivot device;

wherein the shredding device further comprises an end wall in which two bearing housings are provided for supporting a respective second end of the shredding shafts;

wherein the second ends are opposite to the first ends in the axial direction of the shredding shafts;

wherein the end wall is detachably fastened to the housing and is installed and removed as a dual-shaft assembly of end wall and shredding shafts such that installing and removing the end wall installs and removes the end wall and the shredding shafts; and wherein the re-cutting rake is fastened to the end wall of the dual-shaft assembly and to an opposite end wall of the housing by means of a respective fastening device, wherein the fastening device comprises displaceable elements.

* * * * *